US010059550B2

(12) United States Patent
Inoue et al.

(10) Patent No.: US 10,059,550 B2
(45) Date of Patent: Aug. 28, 2018

(54) METHODS AND SYSTEMS FOR PROCESSING FILMS IN PACKAGING MACHINES

(71) Applicant: FUJI MACHINERY. Co., Ltd., Nagoya, Aichi (JP)

(72) Inventors: Kiyokazu Inoue, Aichi (JP); Yoshihito Takeshima, Aichi (JP)

(73) Assignee: FUJI MACHINERY. CO., LTD., Nagoya, Aichi (JP)

( * ) Notice: Subject to any disclaimer, the term of this patent is extended or adjusted under 35 U.S.C. 154(b) by 827 days.

(21) Appl. No.: 14/639,364

(22) Filed: Mar. 5, 2015

(65) Prior Publication Data

US 2015/0259168 A1 Sep. 17, 2015

(30) Foreign Application Priority Data

Mar. 17, 2014 (JP) ..... 2014-053540

(51) Int. Cl.
*B65H 19/12* (2006.01)
*B65H 19/18* (2006.01)

(52) U.S. Cl.
CPC ..... *B65H 19/12* (2013.01); *B65H 19/1847* (2013.01); *B65H 19/1878* (2013.01);
(Continued)

(58) Field of Classification Search
CPC ..... B65H 19/12; B65H 19/1847; B65H 19/1878; B65H 2301/4173;
(Continued)

(56) References Cited

U.S. PATENT DOCUMENTS 3,194,508 A * 7/1965 Netze ..... B65H 19/1815 242/554
3,317,153 A * 5/1967 Raymond ..... B65H 19/181 242/554

(Continued)

FOREIGN PATENT DOCUMENTS

| | | | |
|---|---|---|---|
| JP | 2000-264509 | A | 9/2000 |
| JP | 2005138938 | A | 6/2005 |
| JP | 2005231789 | A | 9/2005 |

OTHER PUBLICATIONS

European Patent Application No. 15157842.4, Extended European Search Report dated Sep. 21, 2015 (4 pages).

*Primary Examiner* — Michael E Gallion
(74) *Attorney, Agent, or Firm* — Conley Rose, P.C.

(57) ABSTRACT

Systems and methods for connecting the films of a first roll and a second roll in a packaging machine. The system includes a cutting device to cut the film of a first roll at a cutting position upstream side of a holding position with respect to a feeding direction toward a former while the film is held by a holding device. The system also includes a robot to move the second roll to a connecting position where a leading end of second roll film overlaps with a film terminal end of the first roll film. The system further includes a connecting device to connect the film leading end of the second roll film to the film terminal end of the first roll film. The robot to move the second roll from the connecting position to a set position after connecting the films, so that the second roll film is tensioned.

14 Claims, 8 Drawing Sheets

(52) U.S. Cl.
CPC ..... *B65H 2301/418* (2013.01); *B65H 2301/4173* (2013.01); *B65H 2301/4185* (2013.01); *B65H 2301/4186* (2013.01); *B65H 2301/4606* (2013.01); *B65H 2511/20* (2013.01); *B65H 2555/31* (2013.01); *B65H 2701/1944* (2013.01)

(58) Field of Classification Search
CPC ..... B65H 2301/418; B65H 2301/4185; B65H 2301/4186; B65H 2301/4606; B65H 2511/20; B65H 2555/31; B65H 2701/1944
USPC .... 242/554.2, 554.3, 555, 555.3–555.6, 556, 242/566.1, 557
See application file for complete search history.

(56) References Cited

U.S. PATENT DOCUMENTS 3,409,242 A * 11/1968 Kishioka ..... B65H 23/005 242/534.2
3,771,737 A * 11/1973 Swann ..... B65H 19/1821 226/100
3,891,158 A * 6/1975 Shearon ..... B65H 19/14 156/504
3,974,490 A * 8/1976 Mori ..... B65H 19/1836 242/554
4,543,152 A * 9/1985 Nozaka ..... B65H 19/102 156/157
4,575,016 A * 3/1986 Pali ..... B65H 19/10 221/14
4,575,017 A * 3/1986 Pali ..... B65H 19/102 156/157
4,892,263 A * 1/1990 Beisswanger ..... B65H 19/126 156/508
4,934,624 A * 6/1990 Grollimund ..... B65H 19/123 242/520
5,152,472 A * 10/1992 Spang ..... B65H 19/1815 242/554.2
5,337,969 A * 8/1994 Martin ..... B65H 19/1815 242/553
5,692,698 A * 12/1997 Forbes ..... B65H 19/1821 242/533.4
5,849,123 A * 12/1998 Rice ..... B65H 19/18 156/157
5,935,361 A * 8/1999 Takahashi ..... B65H 19/102 156/159
2004/0118964 A1* 6/2004 Long ..... B65H 19/126 242/554.2
2006/0169826 A1* 8/2006 Benvenuti ..... B65H 19/1836 242/552
2007/0278341 A1* 12/2007 Tsurunaga ..... B65H 19/1821 242/554.2
2010/0264248 A1* 10/2010 Butterworth ..... B65H 19/1847 242/552
2013/0056576 A1* 3/2013 Andrews ..... A61F 13/15577 242/560
2015/0259168 A1* 9/2015 Inoue ..... B65H 19/12 242/553
2016/0060059 A1* 3/2016 Macura ..... B65H 16/10 242/555.1
2016/0060060 A1* 3/2016 Macura ..... B65H 16/04 242/558
2016/0060062 A1* 3/2016 Macura ..... B65H 16/10 242/552
2017/0088380 A1* 3/2017 Mark ..... B65H 19/14

* cited by examiner

METHODS AND SYSTEMS FOR PROCESSING FILMS IN PACKAGING MACHINES

CROSS-REFERENCE TO RELATED APPLICATIONS

This application claims priority to Japanese patent application serial number 2014-053540, filed Mar. 17, 2014, the contents of which are incorporated herein by reference in their entirety for all purposes.

STATEMENT REGARDING FEDERALLY SPONSORED RESEARCH OR DEVELOPMENT

Not Applicable.

BACKGROUND

Embodiments of the present disclosure relate to methods and systems for processing films in packaging machines.

Packaging machines for forming packages from a film continuously unwound from a film roll are known. In some occasions, for example, in the case that the film of the film roll being used (hereinafter called "old film roll") has been used up, the film of the old film roll may be connected to a film of a new film roll by way of a film connecting device, so that the old film roll can be exchange with the new film roll. In order to minimize troublesome operations by the operator, it is desirable to automate the operation for exchanging the old film roll with the new film roll. To this end, Japanese Laid-Open Patent Publication No. 2000-264509 has proposed a connecting device that utilizes a robot.

However, in the above publication, the robot operates only for transferring a film roll between a pallet and the connecting device. The robot is not fully used for the connecting operation.

Therefore, there has been a need in the art for methods and systems for processing films in packaging machines, which can take advantage of use of a robot.

SUMMARY

In one aspect according to the present disclosure, a film processing method may be provided for automatically connecting a film of a first film roll and a film of a second film roll to be exchanged with the first film roll in a packaging machine. According to the film processing method, a film of the first film roll may be held at a holding position by a holding device, while the first film roll is supported by a robot, and the film is unwound from the first film roll and extends to a former in a tensioned state. In this state, a cutting device may be operated for automatically cutting the film of the first film roll at a cutting position on an upstream side of the holding position with respect to a feeding direction toward the former while the film is held by the holding device. After that, the robot may be operated for moving the first film roll having the film automatically cut to a storage section, so that the first film roll is stored at a storage section. The storage section may be located within a movable range of the robot and may store the second film roll. The robot may be operated for taking out the second film roll from the storage section, rotatably supporting the second film roll, and moving the second film roll to a connecting position where a film leading end of a film of the second film roll overlaps with a film terminal end of the film of the first film roll remained on a downstream side of the cut position and held by the holding device. The film terminal end of the first film roll and the film leading end of the second film roll may be connected by a connecting device at the same time the film leading end overlaps with the film terminal end or after the film leading end has overlapped with the film terminal end. Thereafter, the robot may be operated for moving the second film roll from the connecting position to a set position spaced from the connecting position after connecting the films by the connecting device, so that the film of the second film roll is tensioned for feeding to the former.

With this method, it may be possible to provide a film processing technique that may use the robot to achieve a greater possibility in design, such as a spatial layout in the packaging machine.

In one embodiment, before moving to the connecting section, the second film roll taken out from the storage section may be positioned at a connection preparation section by the operation of the robot. The connecting preparation section may be located within the movable range of the robot. An adhesive may be used as the connecting device and may be applied to the film leading end of the film of the second film roll positioned at the connection preparation section, so that the film leading end of the film of the second film roll and the film terminal end of the film of the first film roll are connected to each other by the adhesive at the same time the film leading end overlaps with the film terminal end as a result of movement of the second film roll to the connecting position from the connection preparation section.

In this way, although a rolled diameter and/or a width may vary with change of the film roll, the robot can adjust the position of the film roll so as to be suitable for applying the adhesive according to the rolled diameter or the width of the film roll to be used. Therefore, it may be possible to further increase a possibility in design.

In another embodiment, the film leading end of the second film roll may be attached to a circumferential surface of the second film roll by an adhesive before the second film roll is stored in the storage section. As the second film roll moves from the connecting position to the set position, the film leading end of the second film roll may be separated from the circumferential surface of the second film roll against an adhesive force of the adhesive. The adhesive force of the adhesive may be smaller than a connecting force between the film leading end of the second film roll and the film terminal end of the first second film roll connected by the connecting device.

In this way, as the second film roll moves from the connecting position to the set position by the operation of the robot, the film leading end attached to the circumferential surface of the second film roll by the adhesive may be separated from the circumferential surface. Therefore, it may be possible to achieve simplification, for example, by omitting a dedicated device for separating the film leading end from the circumferential surface of the second film roll.

In a further embodiment, a first adhesive may be applied to one of side edges with respect to a widthwise direction of a part of the film of the first film roll held by the holding device before the film of the first film roll is cut at the cutting position by the cutting device. After the film of the first film roll has been cut, the part of the film may form the film terminal end of the first film roll and may be held by the holding device. A second adhesive may be used as the connecting device and may be applied to the film leading end of the film of the second film roll before the movement of the second film roll to the connecting position, so that the film leading end of the film of the second film roll and the film terminal end of the film of the first film roll are connected to each other by the first adhesive and the second adhesive at the same time the film leading end overlaps with the film terminal end as a result of movement of the second film roll to the connecting position after the second adhesive has been applied to the second film roll. The second adhesive may extend from a position proximal to a film attaching position in the widthwise direction away from the film attaching position. The film attaching position may be set to correspond to a position of the first adhesive applied to the film of the first film roll.

In this way, the second adhesive may be applied to the film leading end of the film of the second film roll such that the second adhesive extends from a position proximal to the film attaching position in the widthwise direction away from the film attaching position. Here, the film attaching position may be set to correspond to a position of the first adhesive applied to the film of the first film roll. Therefore, it may be possible to apply the second adhesive at a desired position without causing the film leading end of the film to be tuned upward or downward. In addition, the film attaching position, where no second adhesive is applied, may be adhered to one of side edges of the part of the film forming the film terminal end by the first adhesive. Therefore, it may be possible to prevent the film leading end and the film terminal end from being tuned up or down during the passage of the film along rollers or through the former of the packaging machine.

The robot may include a first arm and a second arm each having a support portion. The first arm may rotatably support the second film roll. The second arm may support the cutting device.

Therefore, it may be possible to further increase a possibility in design, for example, in terms of ease of adjustment of the cut position and/or the cut length of the film according to change of the film roll to be used.

In another aspect according to the present disclosure, a film processing system may be provided for automatically connecting a film of a first film roll and a film of a second film roll to be exchanged with the first film roll in a packaging machine. The film processing system may include a robot configured to operate according to a film roll exchange command; a cutting device configured to automatically cut the film of the first film roll at a cut position when the film of the first film roll is unwound from the first film roll so as to extend to a former in a tensioned state while the first film roll is supported by the robot; a film holding device configured to hold a film terminal end of the film of the first film roll at a holding position on a downstream side of the cut position with respect to a feeding direction toward the former when the film is cut by the cutting device; and a storage section located within a movable range of the robot and configured to store the first film roll and the second film roll. The robot may be configured to move the first film roll to the storage section after the film has been cut, so that the first film roll is stored at the storage section. The robot may be further configured to take out the second film roll from the storage section, transfer the second film roll to a connecting position, rotatably support the second film roll at the connecting position, and move a film leading end of the second film roll such that the film leading end overlaps with the film terminal end of the film of the first film roll remained after being cut and held by the film holding device. The film processing system may further include a connecting device configured to connect the film leading end of the second film roll to the film terminal end of the film of the first film roll at the same time the film leading end overlaps with the film terminal end or after that film leading end has overlapped with the film terminal end. In this connection, the robot may be further configured to transfer the second film roll from the connecting position to a set position after the films have been connected by the connecting device, so that the film of the second film roll is tensioned for feeding to the former.

With this film processing system, it may be possible to provide a new film processing technique that may use the robot to achieve a greater possibility in design, such as a spatial layout in the packaging machine.

The film processing system may further include a film receiving device disposed at a position on an upstream side with respect to the feeding direction of the film holding device and configured to support the film of the first film roll in a tensioned state. A space may be defined between the film receiving device and the film holding device to allow a cutting tool of the cutting device to move into the space.

With this arrangement, in order to cut the film in the tensioned state, the cutting tool may move into the space defined between the film receiving device and the film holding device. Therefore, it is possible to reduce the risk of damage to the cutting tool. In addition, it is possible to neatly cut the film.

The film holding device may be a film suction device. By holding the film by using the film suction device, it may be possible to hold the film without damaging the film.

The film processing system may further include a film incident angle adjusting device disposed along a film feeding path between the former and the first film roll or the second film roll and configured to adjust an incident angle of the film with respect to the former. The film incident angle adjusting device may include a single guide roller configured to engage the film.

With this construction, the incident angle of the film with respect to the former can be adjusted by the film incident angle adjusting device. In addition, because the film incident angle adjustment device may include a single guide roller, it may be possible to simplify the construction of the packaging machine along the feeding path between the film roll and the former.

DETAILED DESCRIPTION

Figure 1:
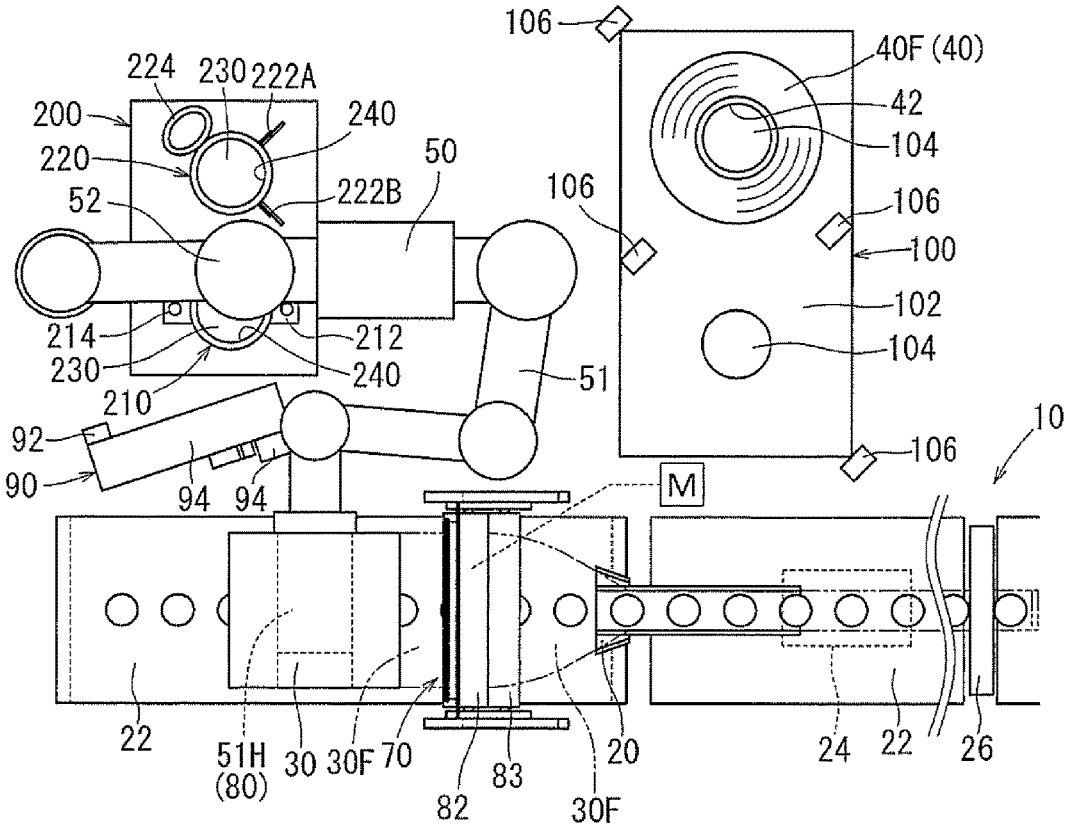
FIG. 1(A) is a schematic plan view of a horizontal form-fill packaging machine incorporating a film processing system according to a representative embodiment.
FIG. 1(B) is a schematic side view of the horizontal form-fill packaging machine of FIG. 1(A) and an enlarged view of a part of the horizontal form-fill packaging machine of FIG. 1(A)
Figure 1B:
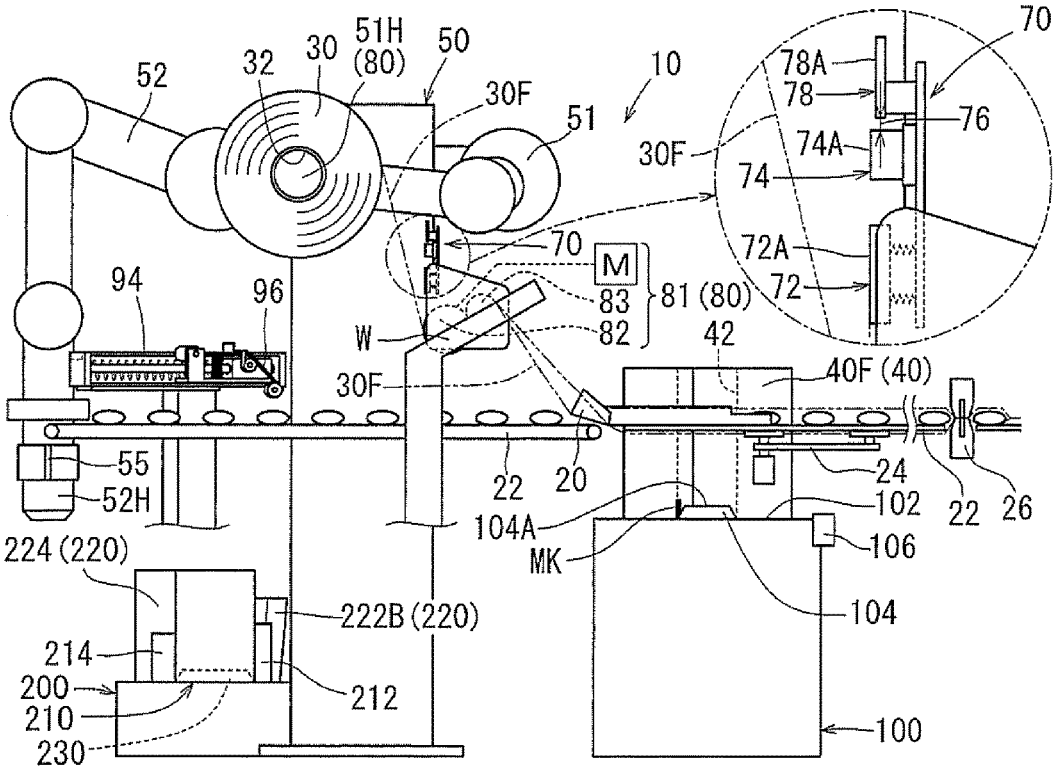

A representative embodiment will now be described with reference to the drawings. In FIGS. 1(A) and 1(B), there is shown a horizontal form-fill packaging machine 10. In the horizontal form-fill packaging machine 10, a web-like film 30F unwound from a film roll 30 may be processed by a former 20 that may fold the film 30F such that opposite side edges in the widthwise direction of the film 30F are lapped with each other. The lapped side edges may be sealed in the lengthwise direction by a lengthwise sealing device 24, so that the film 30F is formed into a tubular film 30F. A conveyer 22 may transfer the tubular film 30. During transfer of the tubular film 30F by the conveyor 22, articles may be filled into the tubular film 30F at predetermined intervals while an end sealer 26 may seal the tubular film 30F in a direction transverse to the transferring direction at positions on a front side and a rear side with respect to the transferring direction of each of the articles. Thereafter, the tubular film 30F may be cut at the transverse seal portions, so that a plurality of packages each containing the article can be manufactured.

The horizontal form-fill packaging machine 10 may further include a robot 50. For example, the robot 50 may operate upon receipt of an exchange command for exchanging the film roll 30 with a film roll 40. The film roll 30 will be hereinafter also referred to as "old film roll 30," and the film roll 40 will be hereinafter also referred to as "new film roll 40." The exchange command may be generated based on information from a detecting device that may detect the residual amount of the film 30F of the film roll 30 that is being used, or based on information regarding change of articles to be filled. According to the exchange command, the robot 50 may operate to transfer the film 30F of the film roll 30, transfer a film 40F of film roll 40, and connect the film 30F of the film roll 30 and the film 40F of the film roll 40 to each other as will be explained later.

The robot 50 may be a dual-armed 15-axis multijoint robot and may have a first arm 51 and a second arm 52 that respectively have a first support portion 51H and a second support portion 52H connected to their leading ends (see FIG. 1(B)). Each of the first arm 51 and the second arm 52 may have a plurality of arm portions joined in series with each other by a plurality of joints that may be similar to a human shoulder joint or a human elbow joint, so that each of the arms 51, 52 is configured for a rotational movement, and a bending and stretching movement. The first support portion 51H may be designed for exchangeably supporting the film roll 30 and the film roll 40, while the second support portion 52H may be designed for exchangeably supporting various working tools used for the connecting operation. Therefore, the film roll 30 or 40 supported by the first support portion 51H and the working tool(s) supported by the second support portion 52H may be moved along suitable linear paths within a three-dimensional space defined by an upward and downward axis, a frontward and rearward axis and a leftward and rightward axis. The first arm 51 may include a motor or any other drive device that can rotate the first support portion 51H together with the supported film roll 30, 40 relative to the arm 51 and can stop the rotation at a desired rotational position. Similarly, the second arm 52 may include a motor or any other drive device that can rotate the second support portion 52H together with the working tool(s) relative to the arm 52 and can stop the rotation at a desired rotational position. The robot 50 may be arranged at a position spaced laterally from the conveyer 22. The robot 50 may include a controller coupled to a control device that may control the packaging operation of the packaging machine 10. The controller of the robot 50 may receive various operation commands including the roller exchange command from the control device of the packaging machine 10. Therefore, according to the operation commands, the robot 50 may operate for cutting the film, transferring the film rolls 30 or 40, and supporting the film rolls 30, or 40 and the working tool(s). The first arm 51 may be located on an article discharge side (front side), while the second arm 52 may be located on an article supply side (rear side). Each of the first support portion 51H and the second support portion 52H are connected to the first arm 51H and the second arm 52H, respectively, and may include a plurality of engaging members 55 that can move into and out of the outer peripheral surface of the first support portion 51H and the second support portion 52H, respectively. Around the robot 50, within the movable range of the first arm 51, a first setting section 100, a connection preparation section 90 and a connection operation section 70 may be arranged. The first setting section 100 may serve as a storage section capable of supporting and storing the film roll 30 and the film roll 40 (or a plurality of film rolls 40). On the other hand, within the movable range of the second arm 52, a second setting section 200 and a connection preparation section 90 may be arranged. The second setting section 200 may support and store a plurality of connection working tools 210 and 220 that may be detachably mounted to the second support portion 52H and may be used for the film connecting operation that will be described later.

The engaging members 55 of the first support portion 51H can be engaged with and disengaged from attachment holes 32 formed in the inner circumferential surfaces of the film roll 30, so that the film roll 30 can be prevented from rotating relative to the first support portion 51H and can be permitted to rotate relative to the first support portion 51H. Similarly, the engaging members 55 of the first support portion 51H can be engaged with and disengaged from attachment holes 42 formed in the inner circumferential surface of the film roll 40, so that the film roll 40 can be prevented from rotating relative to the first support portion 51H and can be permitted to rotate relative to the first support portion 51H. Further, each of the connection working tools 210 and 220 may have attachment holes 24 formed in the inner circumferential surface thereof. The engaging members 55 of the second support portion 52H can be engaged with and disengaged from the attachment holes 24 of the connection working tool 210 or 220, so that the connection working tool 210 or 220 can be prevented from rotating relative to the second support portion 52H and can be permitted to rotate relative to the second support portion 52H.

After the operation for connecting the old and new films (e.g., films 30 and 40, respectively) as will be explained later, with the engaging members 55 having engaged with the attachment holes 42 of the film roll 40 (i.e., new film roll), the robot 50 may operate to move the first support portion 51H such that the film roll 40 moves from a film connecting position above the conveyor 22 to a set position spaced obliquely rearward and upward of the film connection position and is thereafter held at the set position. In this way, the robot 50 may serve as a positioning device for positioning the film roll 40 at the set position. In addition, when the film roll 40 is held a the set position, the first support portion 51H may serve as a film roll support device for rotatably supporting the film roll 40 about an axis extending in a horizontal direction. The film roll support device may be a part of a film supply section 80 for supplying the film 40F in a form of a web to the former 20. Upon receipt of an exchange command for exchanging the film roll 30 with the film roll 40, the robot 50 may operate to move the first arm 51 such that: (i) the first arm 51 having the film roll 30 supported thereon transfers the film roll 30 to an old film roll storing position of the first setting section 100; (ii) the first arm 51 takes a new film roll 40 from a new film roll storing position of the first setting section 100 and transfers the new film roll 40 to the set position; and (iii) the first arm 51 transfers the film 40F of the new film roll 40 to the film connecting position for connection with the film 30F of the old film roll 30. On the other hand, the robot 50 may operate to move the second arm 52 such that: (a) at the second set section 200, the second support portion 52H engages and holds each of the connection working tool 210 and 220 used for automatically exchanging the film roll 30 with the film roll 40 and for automatically connecting the film 30F and the film 40F; and (b) the second arm 52 moves to return each of the connection working tools 210 and 220 to its original storing position of the second set section 200 after the operation of each of the connection working tools 210 and 220 has been finished.

The film supply section 80 may be arranged between the former 20 and the first support portion 51H serving as the film roll support device for supporting the film roll at the set position. The film supply section 80 may include a feeding device 81 that may include a drive roller 82 and a driven roller 83. The drive roller 82 may be rotatably driven by a servo motor M or any other suitable drive device. The film 30F (or 40F) drawn from the film roll 30 (or 40) positioned at the set position may extend along the circumferential surface of the drive roller 82, thereafter extend along the circumferential surface of the driven roller 83 disposed to be opposed to the drive roller 82 at a position obliquely forward and upward thereof, and subsequently extend toward the former 20 that is located on the lower side of the driven roller 83. The drive roller 82, the driven roller 83, and the servo motor M constituting the feeding device 80 may be supported as a unit by a body frame W (see FIG. 1(B)) via a slide support mechanism (not shown) that may support the unit such that the unit can slidably move relative to the body frame W both in frontward and rearward directions and in upward and downward directions in order to allow adjustment of the position of the unit. By adjusting the position of the unit, it may be possible to adjust an incident angle of the film 30F (or 40F) extending from the driven roller 83 toward the former 20. In this way, the unit in association with the slide support mechanism may serve as a film incident angle adjusting device. More specifically, by changing the position of the driven roller 83, the incident angle of the film 30F (or 40F) to the former 20 may be adjusted. Therefore, the driven roller 83 may serve as a film incident angle adjusting roller. In this way, the film supply section 80 provided between the first support portion 51H and the former 20 may include the film incident angle adjusting roller that may also serve as a guide roller for the film 30F (or 40F). Therefore, the construction of the film supply section 80 can be simplified.

Figure 2A:
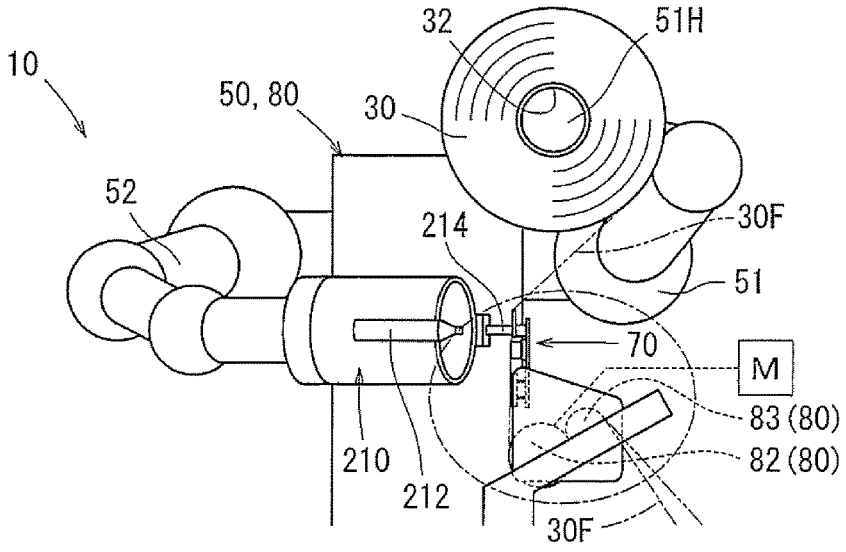
FIG. 2(A) is a side view of a robot of the film processing system of FIG. 1(A) showing a first tool attached to the robot and used for its operation.
Figure 2:
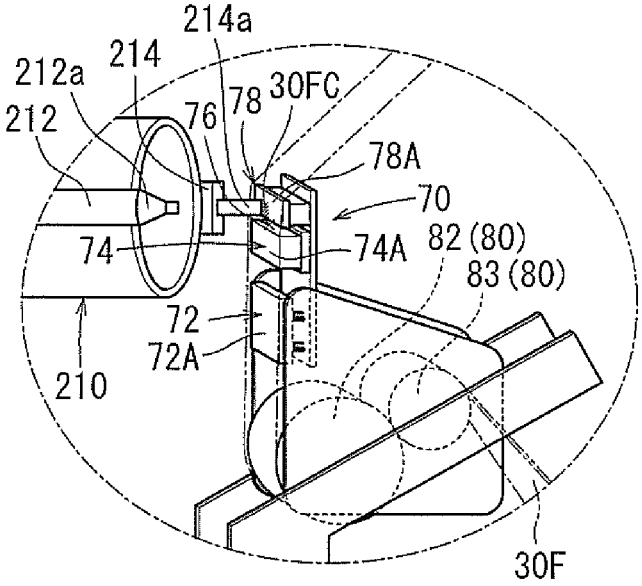
FIGS. 2(B) and 2(C) are schematic perspective views showing the operation for applying glue to a film that is being used.
FIG. 2(D) is a schematic perspective view similar to FIGS. 2(B) and 2(C) but showing the operation for putting a mark on the film.
Figure 2:
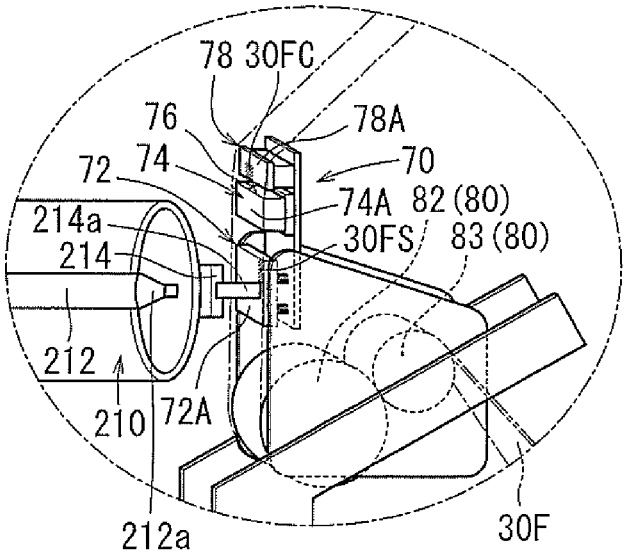

When the first arm 51H supporting the film roll 30 by the first support portion 51 has moved to move the film roll 30 from the set position to a tensioning position obliquely forward and upward from the set position shown in FIG. 2(A), the connection operation section 70 may act on a part of the film 30F extending from the film roll 30 to the drive roller 82, so that the film 30F is tensioned to extend in a film feeding direction while the film 30F maintains a web form. Even after the film roll 30 has moved from the set position to the tensioning position, a relatively weak braking force may be applied to the first support portion 51H against its rotation, so that the film 30F can be kept in the tensioned state. In this way, the robot 50 and the connection operation section 70 may serve as a film tensioning device for tensioning the film 30F, for example, during a cutting operation of the film 30F as will be explained later.

Referring now to FIGS. 2(A)-2(D), the connection operation section 70 may include a film support portion 72, a film suction portion 74 (film holding device) and a film receiving portion 78. The film support portion 72 may include a flat surface portion 72A that may be made of elastically deformable member, so that the flat surface portion 72A can elastically support the films 30F and 40F when the robot 50 has operated to press a front surface of a leading end 40FA of the film 40F, to which a double-sided adhesive tape 96 with adhesive serving as a connecting device is attached, against a back surface of a terminal end 30FZ of the film 30F (see FIGS. 6(A) and 6(B)). The film suction portion 74 may be spaced upward from the film support portion 72 and may include a suction surface 74A for suctioning the film 30F. The suction surface 74A may extend substantially within the same plane as the flat surface portion 72A or may be positioned to extend rearward therefrom. The film receiving portion 78 may be spaced upward from the film suction portion 74 and may include a flat surface portion 78A that can support the film 30F at a position frontward of the film suction portion 74. A slot or a space 76 may be defined between the film suction portion 74 and the film receiving portion 78, so that cutting edges of cutters 222A and 222B (e.g., see FIGS. 1(A) and 1(B)) serving as a part of a cutting device can move into and out of the space 76 for cutting the tensioned film 30F according to command signals regarding the film cutting operation, which may be outputted from the controller. The flat portions 72A and 78A and the suction surface 74A may have widths each greater than the width of the film 30F and the film 40F and may extend parallel to each other. The positions of the film support portion 72, the film suction portion 74, the film receiving portion 78 and the film feeding section 80 along the feeding direction may be determined such that when the film roll 30 is positioned at the tensioning position, irrespective of possible change of the diameter of the film roll 30: (1) the film 30F may extend toward the flat surface portion 78A from the front side thereof so as to always contact with the flat surface portion 78A so as to ensure that the suction surface 74A contacts the tensioned film 30F; and (2) the outer circumferential surfaces of the film roll 30 and 40 do not contact or interfere with the suction surface 74A of the suction portion 74 when the film 30F is pressed against the flat surface portion 72A of the film support portion 72.

Figure 5A:
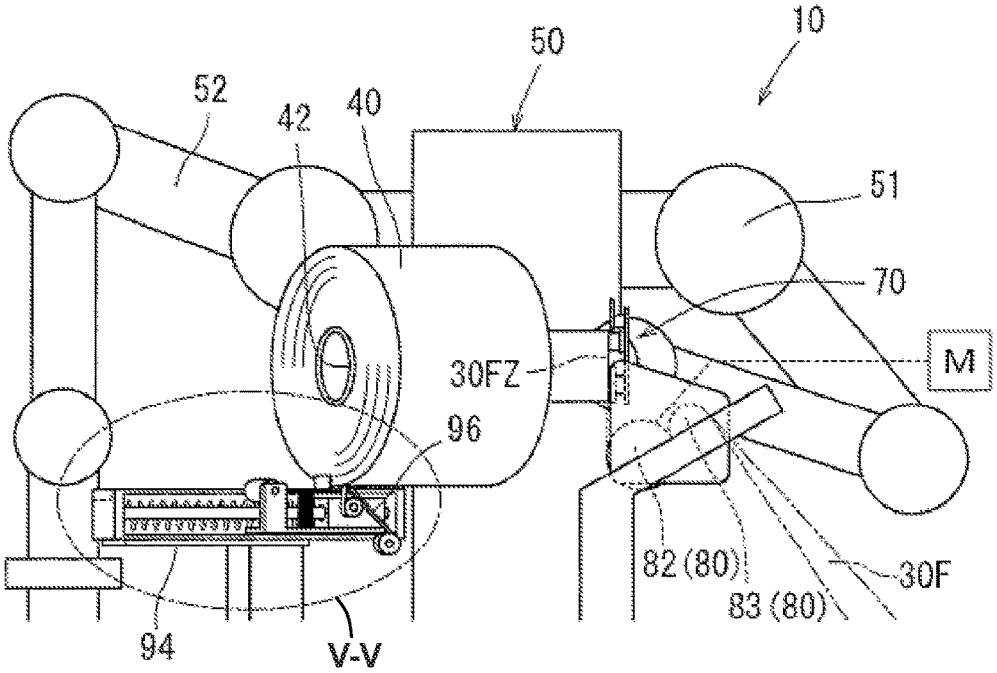
FIG. 5(A) is a schematic perspective view showing the operation of the robot of FIG. 2(A) for attaching a double-faced adhesive tape to a new film roll.
Figure 5B:
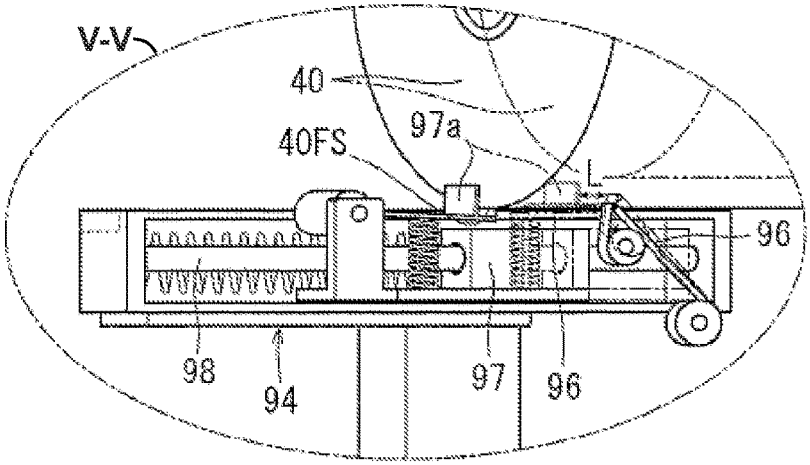
FIG. 5(B) is an enlarged view of section V-V of FIG. 5(A)

Referring again to FIGS. 1(A) and 1(B), the connection preparation section 90 may include a mark detection device 92 and a tape attaching device 94. The mark detection device 92 may detect a mark MK marked on at least a part of the circumferential surface of the new film roll 40 and indicative of the film leading end 40FA (see FIG. 6(A)). The tape attaching device 94 may attach the double-sided adhesive tape 96 (with the adhesive serving as the connecting device) to the front surface of the film leading end 40FA. As shown in FIG. 5(B), the tape attaching device 94 may include a block 97 and a claw 97*a* extending from the block 97. The block 97 is biased by a spring and movable along a rod 98 in a horizontal direction. The film roll 40 may be moved according to the movement of the first arm 51 such that: (a) the film roll 40 engages the claw 97*a* positioned to be spaced from an upper end of a carrier of the double-sided adhesive tape 96 by a distance L; and (b) the film roll 40 moves the block 97 via the claw 97*a* in a horizontal direction along the rod 98 by compressing the spring as shown in FIG. 5(B). During this movement of the block 97 and the claw 97*a*, the double-sided adhesive tape 96 may contact with the film leading end 40FA of the film roll 40 so as to be attached to extend in a widthwise direction of the film start end 40FA.

As shown in FIGS. 1(A) and 1(B), the first set section 100 may include a loading surface 102, where the film rolls 30 and 40 can be set. The loading surface 102 may include a plurality of upwardly oriented projections 104 at positions corresponding to the storing positions of the film rolls 30 and 40. The projections 104 may have an outer diameter sized for fitting into the attachment hole 32 formed in the film roll 30 to extend along the central axis thereof and for fitting into the attachment hole 42 formed in the film roll 40 to extend along the central axis thereof. An upper end portion 104A (see FIG. 1(B)) of each projection 104 is shaped such that each projection 104 can support the film roll 30 (or 40) in such a manner that the axis of the attachment hole 32 (or 42) of the film roll 30 (or 40) is oriented vertically even in the case that the film 30F (or 40F) of the film roll 30 (or 40) is wound eccentrically relative to the axis of the attachment hole 32 (or 42). Therefore, the first support portion 51H can reliably engage the attachment hole 32 (or 42) by the engaging members 55. The first set section 100 may further include a plurality of film roll detection devices 106 that can detect whether or not each of the film rolls 30 and 40 is set at the first set section 100. Based on the information detected by the film roll detection devices 106, the robot 50 can set the film roll 30 at any of the storing positions where no film roll is stored, and the robot 50 may take out the film roll 40 to be exchanged with the film roll 30, from its storing position according to the exchange command.

The connection operation tools 210 and 220 for attachment to the second support portion 52H may be loaded on the second set section 200. The connection operation tool 210 and the connection operation tool 220 will be hereinafter also referred to as a first tool 210 and a second tool 220, respectively. As shown in FIGS. 2(A), 2(B), 2(C) and 2(D), the first tool 210 may include a marking device 212 and a container 214 attached to a hollow cylindrical body at positions spaced from each other by a given distance. The marking device 212 may be a permanent marker. The container 214 may contain glue or any other suitable adhesive. An applicator 214*a* may be attached to a tip end of a container body of the container 214 for applying the glue to the film 30F as will be explained later. Covers may be disposed at the second set section 200 and can be fitted with the applicator 214*a* and a marker tip 212*a* of the marking device 212, which may be a pen tip of a permanent marker, so that the applicator 214*a* and the marker tip 212*a* may be prevented from drying out. The second tool 220 may include two different kinds of cutters 222A and 222B and an elastically deformable film holder 224 that are attached to a hollow cylindrical body at positions spaced from each other by given distances.

In order to enable that the second support portion 52H can easily take out the first and second tools 210 and 220, the second set section 200 may be provided with positioning guides 230 that can support the first and second tools 210 and 220 in such a manner that the first and second tools 210 and 220 are oriented vertically in an upright manner and are positioned with respect to the circumferential direction about their respective hollow cylindrical bodies for alignment with the second support portion 52H with respect to the rotational direction thereof.

In the above packaging machine 10, the film roll 30 may be automatically exchanged with the film roll 40, and the film 30F of the film roll 30 may be automatically connected to the film 40F of the film roll 40 as will be hereinafter described.

Figure 2D:
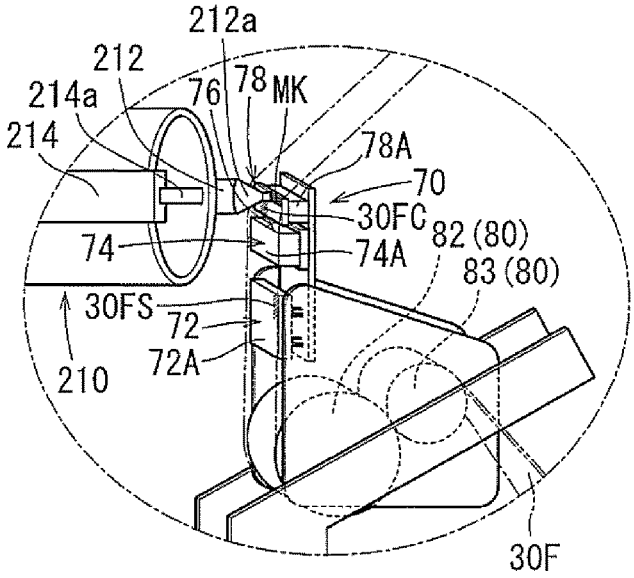

During the packaging operation using the film 30F of the film roll 30, the film roll 30 may be supported by the first support portion 51H and may be positioned to be fixed at the set position by the first arm 51, while the film 30F is guided by the feeding device 81 so as to be fed to the former 20. When the exchange command is outputted form the controller, for example, during stopping of the packaging operation, the robot 50 may automatically perform the connecting operation of the film 30F of the film roll 30 and the film 40F of the film roll 40. To this end, as shown in FIGS. 1(A) and 1(B) and FIG. 2(A), the first arm 51 may move the film roll 30 from the set position to the tensioning position obliquely forward and upward of the set position in a parallel translation manner, while the first support portion 51H may apply a weak braking force to the film roll 30 against its rotation. The braking force may be small enough to allow rotation of the film roll 30. Therefore, the film 30 may be drawn or unwound from the film roll 30, while the flat surface portion 78A and the suction surface 74A and the flat surface portion 72A are in contact with the film 30F to keep a part of the film 30F on an upstream side of the drive roller 82 in a tensioned state. In this state, when the control device outputs a film suction command, the film 30F may be suctioned by the suction portion 74 (film holding device) and may be held in position. The suctioned state of the film 30F may be maintained until the connecting operation of the films 30F and the film 40F is completed. In conjunction with the tensioning operation of the film 30F by the movement of the first arm 51, the second arm 52 may be moved for taking out the first tool 210 (including the marking device 212 and the glue container 214) from the second set section 200 and for holding the first tool 210. Thereafter, the second arm 52 moves the first tool 210 to a position on the rear side of the connecting operation section 70, where the applicator 214*a* may apply the glue to the back surface of the film 30F at two positions as shown in FIGS. 2(B) and 2(C). One of the two positions where the glue is applied may be determined at a central portion 30FC with respect to the widthwise direction of a part the film 30F, which forms a film leading end 30FA of the film 30F when the film 30F is cut after being drawn from the film roll 30, and which is supported by the flat surface portion 78A (see FIG. 2(B)). The other of the two positions may be determined at a side edge 30FS on one side with respect to the widthwise direction of a part of the film 30F, which forms a film terminal end 30FZ of the film 30F on the downstream side of the cut position of the film 30F with respect to the feeding direction, and which is supported by the flat surface portion 72A (see FIG. 2(C) and FIG. 3(B)). Next, the second support portion 52H may rotate to position the marking device 212 of the first tool 10 so as to face the film 30F as shown in FIG. 2(D), and after that, the marking device 212 may be operated to put a mark MK on the back surface of a part of the film 30F, which is supported by the flat surface portion 78A. The position of the mark MK may be determined at one of the side edges with respect to the widthwise direction of the film 30F and nearer to the film roll 30 than the applying position of the glue to the central portion 30FC.

Figure 3A:
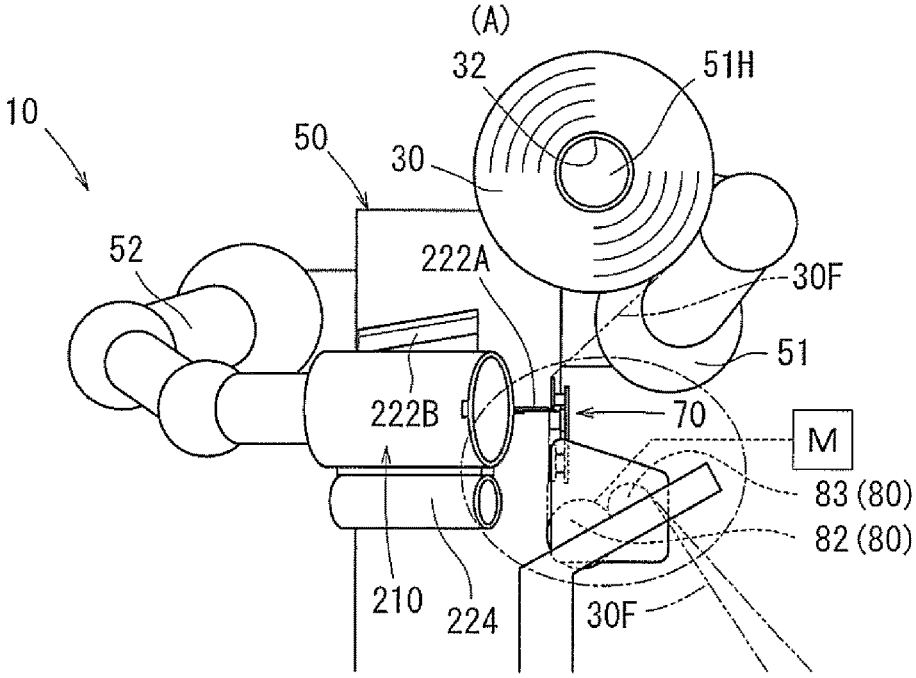
FIG. 3(A) is a view of the robot of FIG. 2(A) including a second tool attached to the robot and used for its operation.
Figure 3:
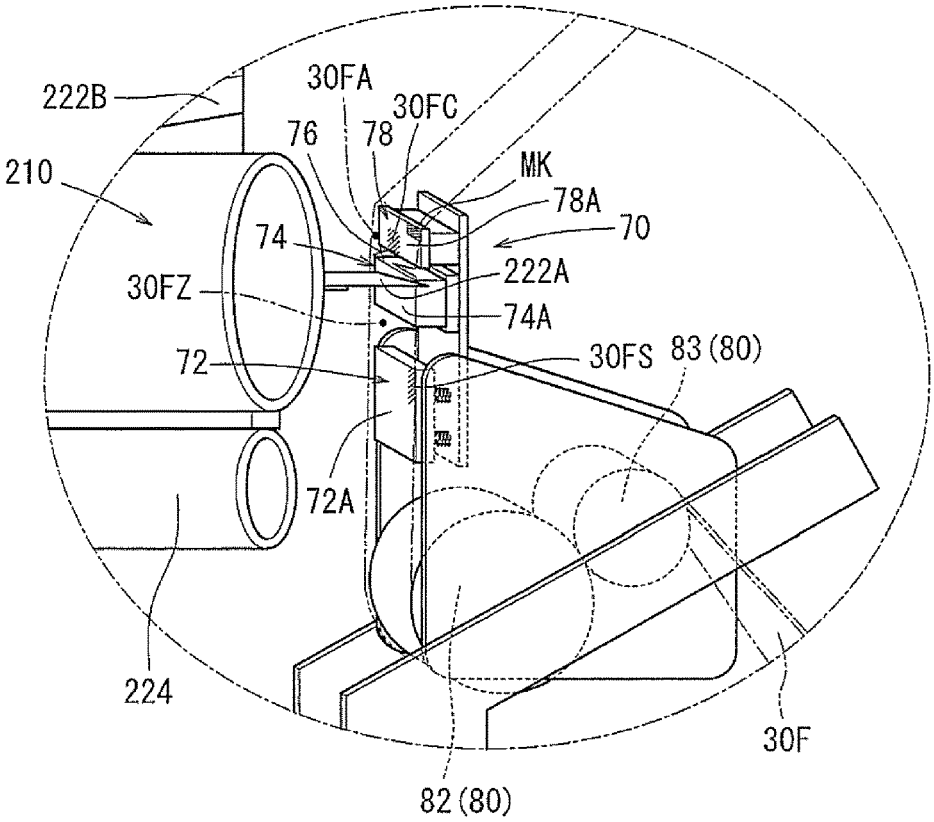
FIG. 3(B) is a schematic perspective view showing the operation of the robot of FIG. 2(A) for cutting the film.

After the operation of the first tool 210 has been finished, the robot 50 may operate the second arm 52 to return the first tool 210 to the original storage position of the second set section 200. Thereafter, the second arm 52 may take out the second tool 220 (including the cutters 222A and 222B and the film holder 224) from the second set section 200 and holds the second tool 220. The second arm 52 may then move the second tool 220 to a position on the rear side of the connecting operation section 70 as shown in FIG. 3(A). At this position, the second tool 220 may automatically cut a part of the tensioned film 30F, which is opposed to the space 76 defined between the suction portion 74 and the film receiving portion 78 (see FIGS. 2(A)-2(D)). More specifically, the cutting edge of cutter 222A may move into the space 76 such that: (a) the cutting edge first cuts through a substantially central portion with respect to the widthwise direction of the part of the film 30F facing the space 76; and (b) the cutting edge thereafter moves along the length of the space 76 extending in the widthwise direction of the film 30F to cut the film 30F by a length corresponding to a substantially half the width of the film 30F. The second support portion 52H may then rotate to move the cutting edge of the cutter 222B into the space 76. The cutting edge of the cutter 222B may be oriented in a different direction from that of the cutter 222A. The cutting edge of the second cutter 222B may first move into the substantially central portion of the film 30F and may thereafter move along the length of the space 76 to cut the film 30F by a length corresponding to the remaining half of the width of the film 30F.

Figure 4:
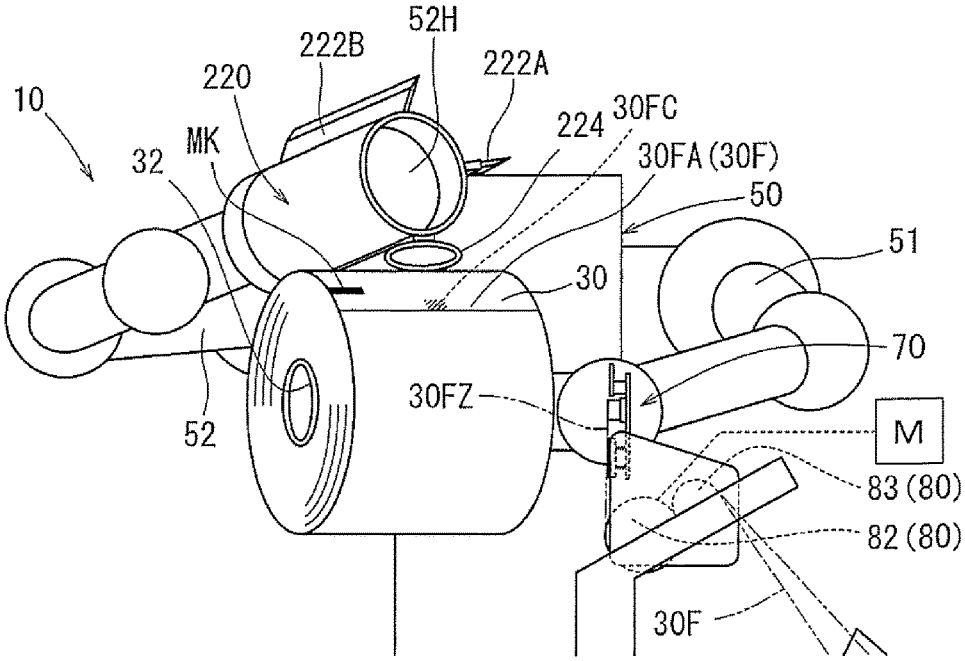
FIG. 4 is a schematic perspective view showing the operation of the robot of FIG. 2(A) for rewinding the film.

After the film 30F has been automatically cut by the cutters 222A and 222B, the first arm 51 may move the film roll 30 rearward from the tensioning position to a position shown in FIG. 4, where the film holder 224 of the second support portion 52H may hold the central portion with respect to the widthwise direction of the outer circumferential surface of the film roll 30. In this state, the first support portion 51H may be driven to rotate the film roll 30, so that the unwound part of the film 30F can be rewound by the film roll 30. Here, during rewinding of the film 30F, the film holder 224 may press the film leading end 30FA, which has the glue applied to the back surface, against the circumferential surface of the film roll 30 from the side of the front surface of the film leading end 30FA, so that the film leading end 30FA can be adhered to the circumferential surface of the film roll 30. At the same time, the film holder 224 may apply a tensioning force to the film 30F during rewinding, so that it may be possible to prevent loosening of the film 30F during transportation of the film roll 30. After the film leading end 30F has been adhered to the film roll 30 by the glue, the first arm 51 may move the film roll 30 to any of the storing positions of the first set section 100. Then, if the presence of the film roll 40 at any of the other storing positions is detected by the film roll detection devices 106 (see FIGS. 1(A) and 1(B)), the first arm 51 may move the first support portion 51H so as to be fitted into the attachment hole 42 of the film roll 40, and the engaging members 55 may engage the attachment hole 42. After that, the first arm 51 may move the film roll 40 to a position within a mark detectable range for detection by the mark detection device 92 of the connection preparation section 90.

Figure 5C:
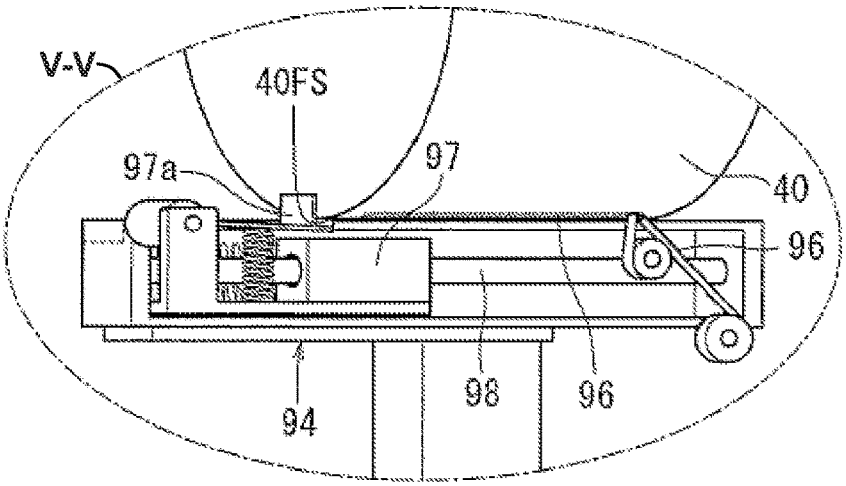
FIG. 5(C) is another enlarged view of section V-V of FIG. 5(B)

With the film roll 40 positioned within the mark detectable range, the first support portion 51H may be driven to rotate the film roll 40 about a horizontal axis, while the mark detection device 92 may detect the position of the mark MK put on the film leading end 40FA of the film 40F of the film roll 40. Based on the information regarding the position of the mark MK, the rotation of the film roll 40 may be stopped at a position where the film leading end 40FA is oriented in a predetermined direction (more specifically, a position where the film leading end 40FA is at a lowermost position of the film roll 40). Then, the first arm 51 may transfer the film roll 40 to a position above the tape attaching device 94 while keeping the first support portion 51H to be oriented in the horizontal direction. After that as is best shown in FIG. 5(A)-5(C), the film roll 40 may be moved to press a film attaching portion 40FS (at one of the side edges with respect to the widthwise direction of the film leading end 40FA) against the block 97 and the claw 97*a* fixedly attached thereto, so that the block 97 and the claw 97*a* move along the rod 98 while the double-faced adhesive tape 96 is attached to the front surface of the film leading end 40FA. The film attaching portion 40FS may be a portion intended to contact the side edge 30FS of the film terminal end 30FZ of the film 30F and may be positioned less than the distance L (see FIG. 5(B)) from the side edge in the widthwise direction.

Figure 6A:
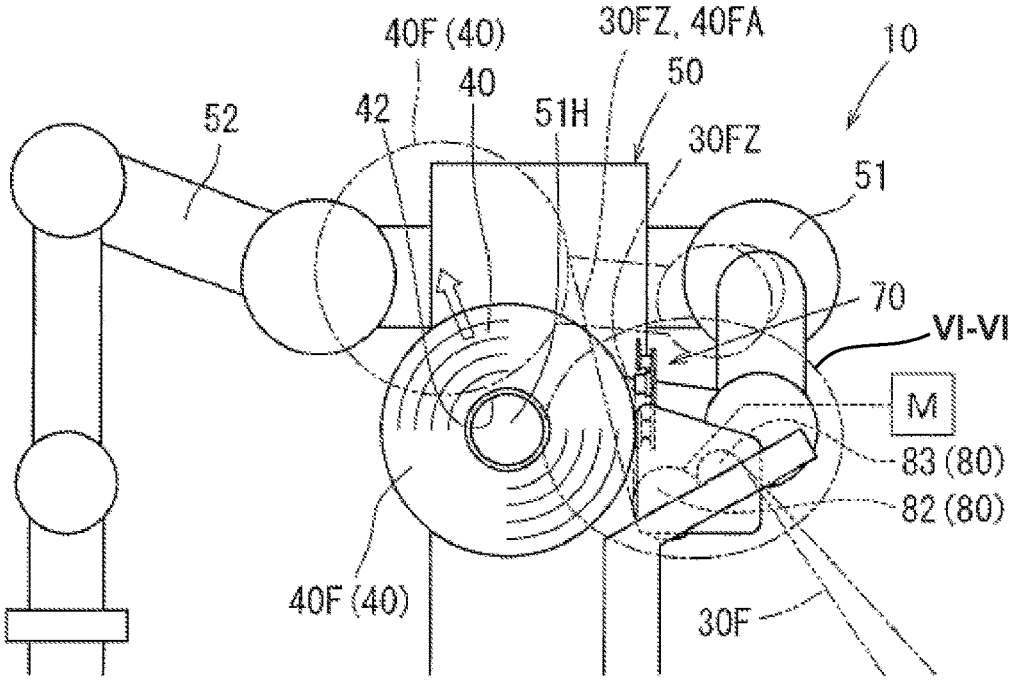
FIG. 6 (A) is a view of the robot of FIG. 2(A) showing the film roll supported at a film connection position.
FIG. 6(B) is an enlarged perspective view of section VI-VI of FIG. 6(A).
Figure 6:
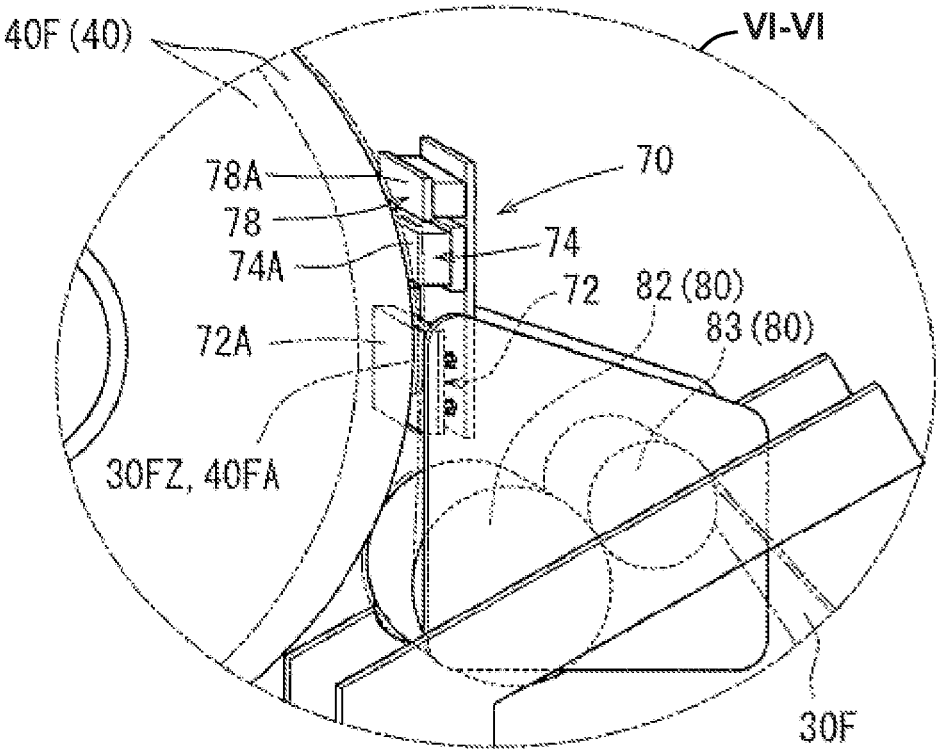

After the double-faced adhesive tape 96 has been attached to the film leading end 40FA of the film roll 40, the robot 50 may operate the first arm 51 to move the film roll 40 rearward in a parallel translation manner as shown in FIG. 6(A), while the first support portion 51H is rotated to a position where the double-faced adhesive tape 96 attached to the film leading end 40FA faces the flat surface portion 72A. After that, the film leading end 40FA is brought to contact the film terminal end 30FZ of the film 30F held by the film suction portion 74 so as to press the double-faced adhesive tape 96 of the film leading end 40FA against the flat surface portion 72A with the film terminal end 30FZ interposed between the double-faced adhesive tape 96 and the flat surface portion 72A. As a result, the front surface of the film leading end 40FA is adhered to the back surface of the film terminal end 30FZ that is being held by suctioning. In this way, the film 30F and the film 40F can be connected to each other. When the double-faced adhesive tape 96 is pressed against the film terminal end 30FZ of the film 30F, a part of the glue applied to the back surface of the film terminal end 30FZ may be pressed against the film leading end 40FA. Therefore, the film 30F and the film 40F are connected with each other through their entire lengths in the widthwise direction by the glue and the double-faced adhesive tape 96. After the connecting operation between the film 30F and the film 40F has been completed, the film roll 40 may be moved in a parallel translation manner from the connecting position for connecting the films 30F and the film 40F by the double-faced adhesive tape 96 to the set position spaced obliquely rearward and upward from the connecting position. During this movement, because the adhesive force of the double-faced adhesive tape 96 may be larger than that of the glue, the film leading end 40FA adhered to the circumferential surface of the film roll 40 may be separated from the circumferential surface, while the connecting state between the film 30F and the film 40F are kept by the double-faced adhesive tape 96. Therefore, the film 40F of the film roll 40 moved from the connecting position to the set position by the first arm 51 may be permitted to be unwound from the film roll 40. After reaching the set position, the film roll 40 may be fixed at the set position. In this way, the operation for automatically exchanging the film roll 30 with the film roll 40 and the operation for automatically connecting the film 30F and the film 40F may be completed.

As described above, the film processing method and the film processing system usable with the horizontal form-fill packaging machine 10 may have the following advantages:

(1) The first support portion 51H may serve as a transfer device for transferring the film rolls 30 and 40 and also serve as a film roll support device for supplying the film 30F and 40F to the film feeding section 80. Therefore, it is possible to connect the film 30F and 40F without need of a plurality of film roll support devices in addition to the transfer device as required in the conventional technique. Therefore, it may be possible to achieve a greater possibility in design, such as a spatial layout and to decrease the number of components. In addition, because it is not necessary to use guide rollers that are necessary in the conventional technique for guiding the films 30F and 40F, the construction of the film feeding section 80 can be further simplified.

(2) Because the glue may be applied to the side edge 30FS on one side of the film terminal end 30FZ, it may be possible to prevent the film leading end 40FZ and the film terminal end 30FZ from turning up and down during the movement of the connecting portion between the film 30F and 40F along rollers or during passage through the former 20.

(3) If the film roll 30 is necessary to be exchanged to another film roll, for example, due to change of article to be packaged, the film 30F may be rewound to the film roll 30 while the film 30F is pressed and squeezed against the outer circumferential surface of the film roll 30, and thereafter, the leading end of the rewound film 30F may be adhered to the outer circumferential surface of the film roll 30 by the glue. Therefore, the rewound state of the film 30F can be properly maintained without being loosened even after the film roll 30 has been removed from the first support portion 51. Hence, if the film roll 30 is used again, the film roll 30 can be transferred by the robot 50 without causing the film to be loosened during transferring. For this reason, the robot 50 can automatically connect the film 30F and the film 40F to be exchanged with the film 30F without misregistration between the films.

(4) In order to automatically cut the film 30F, with the film 30F tensioned between the first support portion 51H and the film suction portion 74, the cutting edge of cutter 222A may move into the space 76 between the film suction portion 74 and the film receiving portion 78 so as to cut through the substantially central portion the tensioned film 30F and to thereafter cut the film 30F by a length corresponding to a substantially half the width of the film 30F, and after that, the cutting edge of the cutter 222B may move into the substantially central portion of the film 30F and may thereafter cut the film 30F by a length corresponding to the remaining half of the width of the film 30F. Therefore, the film 30F can be neatly cut along a straight line in the widthwise direction. In addition, it is possible to reduce the risk of damages to the cutting edges of the cutters 222A and 222B.

(5) In order to attach the double-faced adhesive tape 96 to the film leading end 40FS of the film 40F of the film roll 40 at the connection preparation section 90, the film roll 40 may be moved to press the film attaching portion 40FS against the block 97 and the claw 97*a*, so that the double-faced adhesive tape 96 is attached to the front surface of the film leading end 40FA so as to extend from a position spaced proximal to the film attaching portion 40FS (i.e., a position spaced from the side edge by the distance L) toward the opposite side edge away from the film attaching portion 40FS in the widthwise direction. Therefore, it may be possible to neatly attach the double-faced adhesive tape 96 to the film leading end 40FA at an appropriate position along a straight line in the widthwise direction. This may avoid the film leading end 40FA from turning up and down from the film roll 40, which may occur in the case that the double-faced adhesive tape 96 is attached starting from the side edge of the film 40F.

The above teachings may be applied to any other packaging machines in which a film is unwound from a film roll. In addition, the material of the film may not be limited and may be resin, paper, metal or any other material.

Although the double-faced adhesive tape 96 has been used as a connecting device for connecting the films 30F and 40F in the above embodiment, the connecting device may not be limited to the double faced adhesive tape 96 that is a drying and solidifying type adhesive. Here, the term "drying and solidifying type adhesive" is used to mean an adhesive that contains an adhesive material dissolved in water or solvent. The adhesive material may be solidified after evaporation of water or solvent. For example, the drying and solidifying type adhesive may include glue other than the adhesive tape. Other than the drying and solidifying type adhesive, it may be possible to use a technique such as a heat welding technique and an ultrasonic welding technique. Preferably, the connection device may maintain a connecting state between the films even after the film leading end adhered to the outer circumferential surface of the film roll has been separated from the outer circumferential surface during the transfer of the film roll to the storing position.

Although the glue has been used as an adhesive device for adhering the film leading end to the outer circumferential surface of the film roll, any other drying and solidifying type adhesive such as a double-faced adhesive tape can be used. It may be also possible to use a chemical reaction type adhesive or any other type of adhesive.

Although the double-faced adhesive tape 96 is attached to the film leading end 40FA for connection with the film terminal end 30FZ, it may be possible to attach the adhesive tape 96 to the film terminal end 30FZ held by the film holding device, and thereafter the film leading end 40FA may be pressed against the film terminal end 30FZ for connection by the double-faced adhesive tape 96. Also by this arrangement, the films 30F and 40F can be automatically connected.

It may be possible to provide a supply device such as a conveyor for automatically supplying a new film roll to the first set section at each time the robot takes the film roll from the first set section.

It may be possible to provide a discharge device such as a conveyor for automatically discharge the film roll to the outside of the first set section at each time the film roll is set at the first set section by the robot.

Although the first set section is configured to store the film rolls such that the axes of the film rolls are oriented in the vertical direction, it may be possible to store the film rolls with their axes oriented in the horizontal direction or any other direction as long as the film rolls are within the movable range of the robot. This may be also applied to the second set section.

Although the first support portion 51H is configured to support the film rolls and the second support portion 52H is configured to support the cutting tools in the above embodiment, the first support portion 51H may be configured to support the cutting tools and the second support portion 52H may be configured to support the film rolls.

The robot 50 may include three or more arms for performing film connection operations for a plurality of packaging machines that are suitably arranged.

Although the robot 50 is provided as a separated device from the packaging machine, it may be possible to mount the first and second arms 51 and 52 to a machine body or any of the components of the packaging machine, so that a robot body supporting these arms can be eliminated.

Although the first support portion 51H supports the film roll so as to allow rotation of the film roll during the packaging operation, the first support portion may be rotatably driven to assist the film to be unwound from the film roll.

Although the permanent marker has been used as the marking device 212, the marking device 212 may be a seal attaching device that can attach a seal serving as the mark MK to the back surface of the film 30F.

The mark detection device 92 may detect the position of the mark MK, for example based on image information obtained by an imaging device, such as a camera. It may be also possible to position the first support portion relative to the film roll and to position the second support portion relative to the first and second tools based on image information obtained by an imaging device(s).

The first set section 100 may be separated into a plurality of set sections. For example, the old film roll transferred by the first support portion may be stored in a different set section from that storing the new film roll to be used in the future.

Although the suction portion 74 has been used as the film holding device for holding the film 30F, the film holding device may not be limited to the suction portion 74. For example, plates or claws movable toward and away from the tensioned film 30F in the widthwise direction may be disposed at the connection section 70. The plates or claws may be coupled to an actuator that is operable to move the plates or claws for holding the film from opposite sides according to a command signal from the controller during the film connecting operation.

Although the cutters 222A and 222B serving as a cutting device are moved by the second support portion for cutting the film 30F, the cutters 222A and 222B may be mounted to a different member from the second support portion. For example, the cutters 222A and 222B may be disposed at the connection operation section 70 and may be coupled to an actuator(s). According to a command signal transmitted from the control device to the actuator(s), the cutters 222A and 222B may automatically move into and out of the space 76 formed between the film suction portion 74 and the film receiving portion 78 for cutting the film 30F.

The flat surface portion 78A of the film receiving portion 78 may be replaced with any other surface portion that does not have a flat surface. Thus, variously shaped surface portions may be used as long as they allow the film to be tensioned in the feeding direction and in the widthwise direction.

A suitable roller device, such as a set of parallel rollers movable relative to each other to change a distance(s) therebetween, may be arranged in the film feeding section 80 at a position between the connecting operation section 70 and the feeding device 81. With this arrangement, during the film exchange operation and the cutting operation, a part of the film wound around the rollers of the roller device may be drawn for continuously supplying the film to the former. This may allow a continuous packaging operation or minimize the time necessary for stopping the supply of the film to the former.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved packaging machines, and methods of making and using the same.

Moreover, combinations of features and steps disclosed in the above detailed description may not be necessary to practice the invention in the broadest sense, and are instead taught merely to particularly describe representative examples. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

What is claimed is:

1. A method for automatically connecting a film of a first film roll and a film of a second film roll to be exchanged with the first film roll in a packaging machine, the method comprising:

holding a film of the first film roll at a holding position with a holding device, while the first film roll is supported by a robot, and the film of the first film roll is unwound from the first film roll and extends to a former in a tensioned state;

operating a cutting device for automatically cutting the film of the first film roll at a cutting position on an upstream side of the holding position with respect to a feeding direction toward the former while the film is held by the holding device;

operating the robot so that the robot (a) moves the first film roll having the film automatically cut to a storage section and (b) releases the support of the first film at the storage position to store the first film roll at the storage section, wherein the storage section is located within a movable range of the robot and stores the second film roll;

operating the robot so that the robot (c) takes out the second film roll from the storage section, (d) rotatably supports the second film roll, and (e) moves the second film roll in the rotatably supported state to a connecting position where a film leading end of a film of the second film roll overlaps with a film terminal end of the film of the first film roll remained on a downstream side of the cut position and held by the holding device;

connecting the film terminal end of the first film roll and the film leading end of the second film roll by a connecting device at the same time the film leading end overlaps with the film terminal end or after the film leading end has overlapped with the film terminal end; and operating the robot to move the second film roll from the connecting position to a set position spaced from the connecting position after connecting the films by the connecting device, so that the film of the second film roll is tensioned for feeding to the former.

2. The method according to claim 1, further comprising:

positioning the second film roll taken out from the storage section to a connection preparation section by the operation of the robot before moving the second film roll to the connecting position, the connecting preparation section being located within the movable range of the robot;

using an adhesive as the connecting device and applying the adhesive to the film leading end of the film of the second film roll positioned at the connection preparation section, so that the film leading end of the film of the second film roll and the film terminal end of the film of the first film roll are connected to each other by the adhesive at the same time the film leading end overlaps with the film terminal end as a result of movement of the second film roll to the connecting position from the connection preparation section.

3. The method according to claim 1, further comprising:

attaching the film leading end of the second film roll to a circumferential surface of the second film roll by an adhesive before the second film roll is stored in the storage section; and causing the film leading end of the second film roll to be separated from the circumferential surface of the second film roll against an adhesive force of the adhesive as the second film roll moves from the connecting position to the set position;

wherein the adhesive force of the adhesive is smaller than a connecting force between the film leading end of the second film roll and the film terminal end of the first film roll connected by the connecting device.

4. The method according to claim 1, further comprising:

applying a first adhesive to a side edge with respect to a widthwise direction of a part of the film of the first film roll held by the holding device before the film of the first film roll is cut at the cutting position by the cutting device, wherein, after the film of the first film roll has been cut, the part of the film forms the film terminal end of the first film roll and is held by the holding device; and using a second adhesive as the connecting device and applying the second adhesive to the film leading end of the film of the second film roll before the movement of the second film roll to the connecting position, so that the film leading end of the film of the second film roll and the film terminal end of the film of the first film roll are connected to each other by the first adhesive and the second adhesive at the same time the film leading end overlaps with the film terminal end as a result of movement of the second film roll to the connecting position after the second adhesive has been applied to the second film roll;

wherein the second adhesive extends from a position proximal to a film attaching position in the widthwise direction away from the film attaching position; and wherein the film attaching position is set to correspond to a position of the first adhesive applied to the film of the first film roll.

5. The method according to claim 1, wherein:

the robot includes a first arm and a second arm each having a support portion;

the support portion of the first arm is configured to rotatably support the second film roll; and the support portion of the second arm is configured to support the cutting device.

6. A film processing system for automatically connecting a film of a first film roll and a film of a second film roll to be exchanged with the first film roll in a packaging machine, the system comprising:

a robot configured to operate according to a film roll exchange command;

a cutting device configured to automatically cut the film of the first film roll at a cut position when the film of the first film roll is unwound from the first film roll so as to extend to a former in a tensioned state while the first film roll is supported by the robot;

a film holding device configured to hold a film terminal end of the film of the first film roll at a holding position on a downstream side of the cut position with respect to a feeding direction toward the former when the film is cut by the cutting device;

a storage section located within a movable range of the robot and configured to store the first film roll having the film cut by the cutting device, and the second film roll, wherein the robot is configured to move the first film roll to the storage section after the film has been cut, and release the support of the first film roll at the storage section to store the first film roll at the storage section; and wherein the robot is further configured to take out the second film roll from the storage section, rotatably support the second file roll, transfer the second film roll in the rotatably supported state to a connecting position, rotatably support the second film roll at the connecting position, and move a film leading end of the second film roll such that the film leading end overlaps with the film terminal end of the film of the first film roll remained after being cut and held by the film holding device;

a connecting device configured to connect the film leading end of the second film roll to the film terminal end of the film of the first film roll at the same time the film leading end overlaps with the film terminal end or after the film leading end has overlapped with the film terminal end;

wherein the robot is further configured to transfer the second film roll from the connecting position to a set position after the films have been connected by the connecting device, so that the film of the second film roll is tensioned for feeding to the former.

7. The film processing system according to claim 6, further comprising a film receiving device disposed at a position on an upstream side with respect to the feeding direction of the film holding device and configured to support the film of the first film roll in a tensioned state, wherein a space is defined between the film receiving device and the film holding device to allow a cutting tool of the cutting device to move into the space.

8. The film processing system according to claim 6, wherein the film holding device is a film suction device.

9. The film processing system according to claim 6, further comprising a film incident angle adjusting device disposed along a film feeding path between the former and the first film roll and configured to adjust an incident angle of the film of the first film roll with respect to the former, wherein the film incident angle adjusting device comprises a single guide roller configured to engage the film of the first film roll.

10. A film processing method for a packaging machine, comprising storing a second film roll at a film roll storage section before exchanging the second film roll with a first film roll;

supporting the first film roll with a robot;

cutting a film of the first film roll that extends from the first film roll to a former with a cutting device;

transferring the first film roll having the film cut to the film roll storage section by the robot, releasing the support of the first film roll by the robot at the film roll storage section, so that the first film roll is stored at the film roll storage section;

taking out the second film roll from the film roll storage section by the robot and supporting the second film roll with the robot; and connecting a terminal end of the film of the first film roll remained on the side of the former after being cut and a leading end of the second film roll with a connecting device that is manipulated by the robot.

11. The film processing method according to claim 10, wherein the connecting step comprises:

attaching the connecting device to one of the terminal end of the first film roll and the leading end of the second film roll with the robot; and operating the robot to move the terminal end of the first film roll and the leading end of the second film roll relative to each other, so that the terminal end of the first film roll and the leading end of the second film roll overlap with each other and are connected by the connecting device.

12. A film processing system usable with a packaging machine, comprising:

a robot configured to exchangeably and rotatably support a first film roll and a second film roll and to move the first film roll and the second film roll;

a cutting device configured to cut a film of the first film roll that extends from the first film roll to a former when the robot supports the first film roll;

a connecting device that is configured to be manipulated by the robot and is configured to connect a terminal end of the film of the first film roll remained on the side of the former after being cut and a leading end of the second film roll when the second film roll is exchanged with the first film roll and supported by the robot; and a film roll storage section configured to store the first film roll having the film but by the cutting device and to also store the second film roll before being exchanged with the first film roll, wherein the robot is further configured to transfer the first film roll having the film cut to the film roll storage section, release the support of the first film roll at the film roll storage section to store the first film roll at the film roll storage section, and take out the second film roll from the film roll storage section.

13. The film processing system according to claim 12, further comprising:

an attaching device configured to attach the connecting device to one of the terminal end of the film of the first film roll and the leading end of the film of the second film roll;

wherein the robot is configured to interact with the attaching device, so that the connecting device is automatically attached to one of the terminal end of the first film roll and the leading end of the second film roll; and wherein the robot is further configured to move the terminal end of the first film roll and the leading end of the second film roll relative to each other to connect the terminal end of the first film roll and the leading end of the second film roll with the connecting device.

14. The film processing system according to claim 12, wherein:

the robot includes a first arm and a second arm movable independently of each other;

the first arm is configured to exchangeably support the first film roll and the second film roll;

the second arm is configured to support the cutting device, wherein the cutting device is configured to cut the film by the movement of the second arm.

* * * * *